US007648300B2

(12) United States Patent
Szekely

(10) Patent No.: US 7,648,300 B2
(45) Date of Patent: Jan. 19, 2010

(54) LIQUID DISPENSER WITH AUTO SHUT-OFF

(75) Inventor: Alex Szekely, Jackson, NJ (US)

(73) Assignee: Plastek Industries, Inc., Erie, PA (US)

( * ) Notice: Subject to any disclaimer, the term of this patent is extended or adjusted under 35 U.S.C. 154(b) by 540 days.

(21) Appl. No.: 11/394,566

(22) Filed: Mar. 31, 2006

(65) Prior Publication Data

US 2006/0239762 A1 Oct. 26, 2006

Related U.S. Application Data

(60) Provisional application No. 60/667,719, filed on Mar. 31, 2005.

(51) Int. Cl.
*B43K 1/06* (2006.01)

(52) U.S. Cl. ..... 401/265; 401/263; 401/175

(58) Field of Classification Search ..... 401/172, 401/174, 175, 261, 263, 265, 280, 281; 222/386, 222/387, 390, 503, 142.5
See application file for complete search history.

(56) References Cited

U.S. PATENT DOCUMENTS

| | | | | |
|---|---|---|---|---|
| 3,100,315 | A * | 8/1963 | Laxalt | 401/175 |
| 6,039,483 | A * | 3/2000 | Szekely | 401/50 |
| 6,536,977 | B1 * | 3/2003 | Hammel | 401/205 |
| 6,872,022 | B2 * | 3/2005 | Bertothy | 401/281 |

* cited by examiner

*Primary Examiner*—David J Walczak
(74) *Attorney, Agent, or Firm*—Bachman & LaPointe, P.C.

(57) ABSTRACT

A dispenser includes an outer housing having a top defining an applicator surface and at least one dispensing opening in the applicator surface; and an inner housing defining a product space and having a top comprising at least one passage and at least one vane structure, the top being substantially adjacent to the dispensing opening of the outer housing, wherein the inner housing is rotatable relative to the outer housing around an axis so as to sequentially position the inner housing and the outer housing in an open position wherein the at least one passage of the inner housing is aligned with the at least one dispensing opening of the outer housing, and a closed position wherein the at least one vane structure of the inner housing is aligned with and blocks the at least one dispensing opening in the outer housing.

18 Claims, 2 Drawing Sheets

LIQUID DISPENSER WITH AUTO SHUT-OFF

CROSS REFERENCE TO PROVISIONAL APPLICATION

This application claims the benefit of the filing date of provisional patent application Ser. No. 60/667,719, filed Mar. 31, 2005.

BACKGROUND OF THE INVENTION

The invention relates to dispensers of liquid products such as deodorants and antiperspirant and the like.

Such dispensers typically have an applicator surface with several holes, slots or other openings to allow the liquid product to be delivered from within the dispenser to the applicator surface for application by the user as desired.

With liquid or flowable products, this can be problematic since the dispenser can leak if left on its side, or squeezed even slightly, or during handling for example if packed in luggage.

It is the primary object of the present invention to provide a solution to this problem.

SUMMARY OF THE INVENTION

According to the invention, a dispenser is provided wherein the product is contained within an inner housing which rotates relative to an outer housing, and wherein the outer housing is provided with openings to allow the liquid product to be dispensed from within the inner housing through the openings to an applicator surface of the outer housing. In accordance with the invention, the inner housing has an upper intermittent structure which is aligned with the openings of the outer housing, and which are positioned to automatically seal the openings after dispensing of the product. The inner and outer housings are preferably provided with structure which seats or otherwise urges either or both of the inner housing and outer housing to a relative position wherein the structure of the inner housing blocks the openings in the outer housing as desired. The blocking structure can be provided as a series of vanes arranged to rotate past the inner surface of the openings as the inner housing is rotated relative to the outer housing. These vanes serve not only to close the openings when needed, but also to scrape excess product from the inner side of the openings as the dispenser is operated and thereby help prevent product blockage of the openings.

In further accordance with the invention, a dispenser is provided which comprises an outer housing having a top defining an applicator surface and at least one dispensing opening in the applicator surface; and an inner housing defining a product space and having a top comprising at least one passage and at least one vane structure, the top being substantially adjacent to the dispensing opening of the outer housing, wherein the inner housing is rotatable relative to the outer housing around an axis so as to sequentially position the inner housing and the outer housing in an open position wherein the at least one passage of the inner housing is aligned with the at least one dispensing opening of the outer housing, and a closed position wherein the at least one vane structure of the inner housing is aligned with and blocks the at least one dispensing opening in the outer housing.

The inner and outer housings can advantageously be provided with engageable structures which snap into place as the inner housing is rotated relative to the outer housing. These structures can be overcome to rotate the device, but serve to urge the inner and outer housings into the proper position with the openings sealed as desired.

The dispenser can be provided with a clicker structure as well which serves to help indicate to a user when the dispenser has been operated to dispense a proper amount of product.

The dispenser also preferably has a structure for actuating dispensing which is advantageous. According to the invention, the inner housing has a radially extending wheel which is turned by hand in order to rotate the inner housing relative to the outer housing. This wheel extends radially through side wall openings of the outer housing so that a user can manipulate same. According to the invention, the openings in the side wall of the outer housing are positioned such that a cap when positioned over the top of the package extends downwardly to cover the radially extending wheel and prevent the wheel from being rotated while the package is covered. This helps to prevent inadvertent dispensing of product, and also to prevent application of excess pressure to the product by rotating the wheel while the cap is in place, since such excess pressure can adversely affect some liquid or cream products.

BRIEF DESCRIPTION OF THE DRAWINGS

A detailed description of preferred embodiments of the present invention follows with reference to the attached drawings wherein.

DETAILED DESCRIPTION

Figure 1:
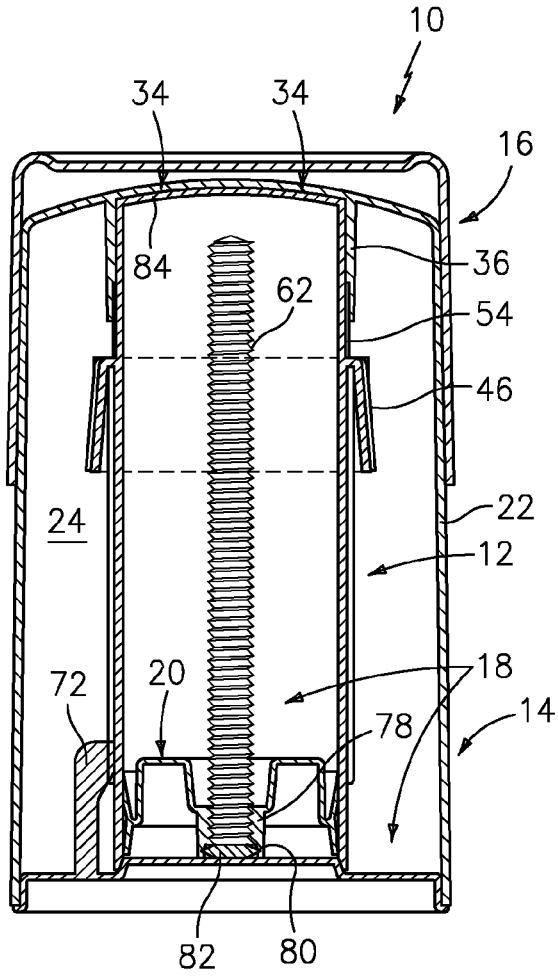
FIGS. 1 and 2 are side sectional views of a dispenser according to the invention.
Figure 2:
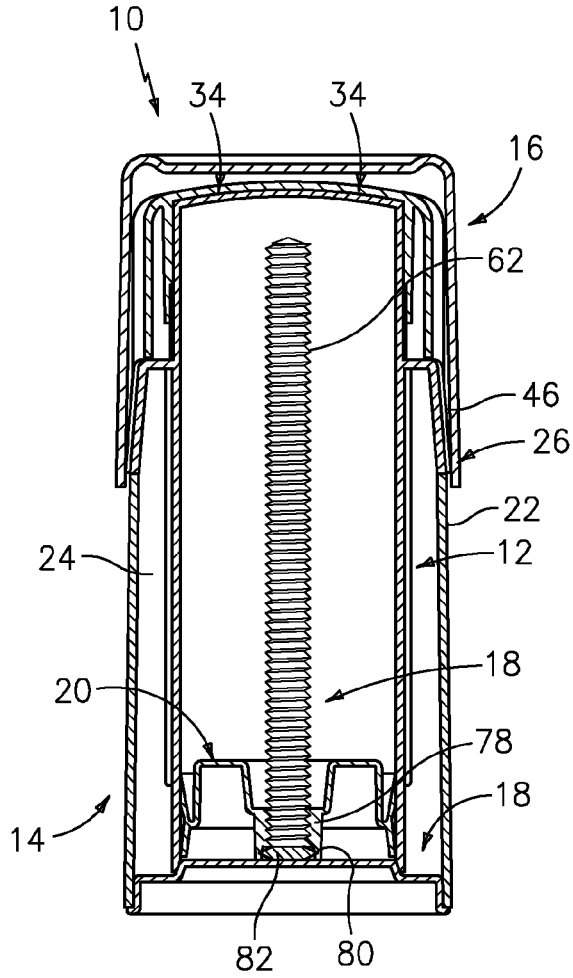

FIGS. 1 and 2 show sectional views of a dispenser 10 according to the invention. The main components of dispenser 10 are an inner housing 12, an outer housing 14, a cap 16, a plug and screw member 18 and a product platform 20. Each of these components will be described further below. A liquid product is typically disposed within inner housing 12 and can be dispensed through openings in outer housing 14 through rotation of inner housing 12 relative to outer housing 14. Operation of dispenser 10 according to the invention will also be further described below.

Figure 3:
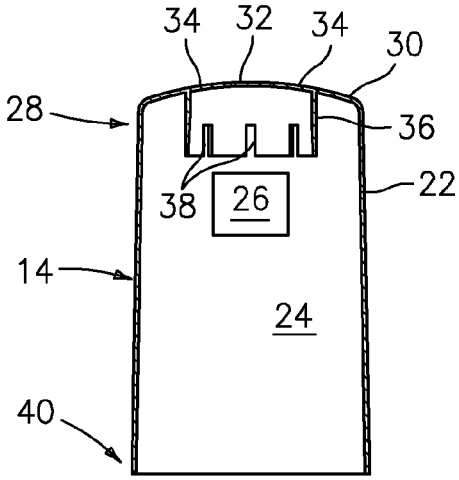
FIG. 3 is a side sectional view of the outer housing component of a dispenser according to the present invention.
Figure 4:
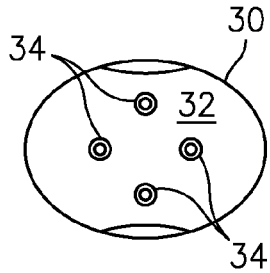
FIG. 4 is a top view of the outer housing of a dispenser according to the present invention.

Referring also to FIGS. 3 and 4, outer housing 14 has a side wall 22 which defines an inner space 24. Side wall 22 has side openings 26, preferably two opposed side openings 26, through which rotatable structure from inner housing 12 extends as will be discussed below.

Outer housing 14 has an upper end 28 which is typically closed by a wall 30 defining an applicator surface 32, and which has a series of openings 34 to allow liquid product to be dispensed to applicator surface 32.

Outer housing 14 may advantageously have an inner downwardly depending skirt member 36 which is sized and positioned to rotatably receive inner housing 12. Skirt 36 defines an inner round rotational surface for receiving the upper end of inner housing 14 in a rotatable manner. Skirt 36 also advantageously has a series of slots 38 or grooves positioned around the perimeter of same as shown.

Outer housing 14 also has a lower end 40 which is typically open to receive the rest of the assembly.

Figure 5:
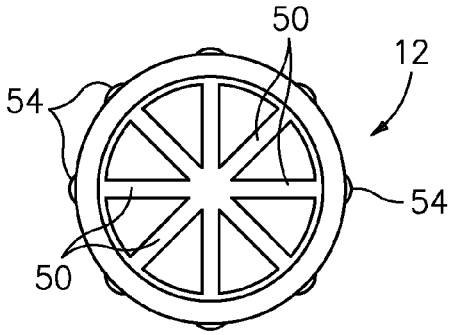
FIG. 5 is a side sectional view of the inner housing component of a dispenser according to the invention.
Figure 6:
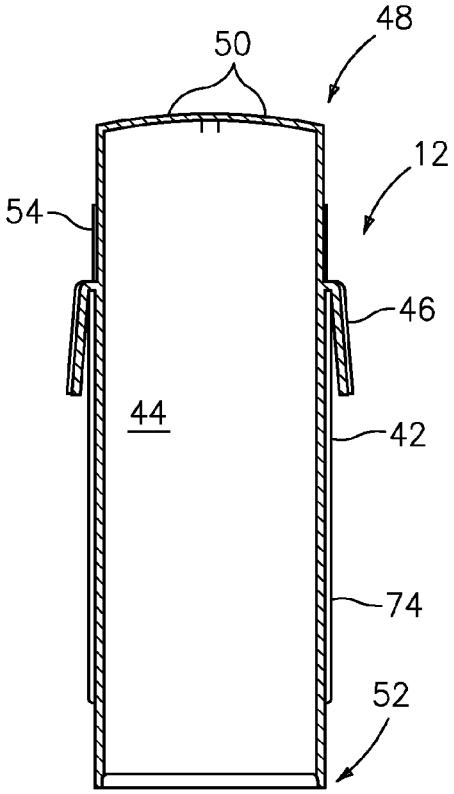
FIG. 6 is a top view of an inner housing component of a dispenser according to the invention.

Referring now also to FIGS. 5 and 6, inner housing 12 has a side wall 42 which defines an inner product space 44, and which has a radially extending wheel 46 extending radially outwardly from same. Wheel 46 can be provided with a textured or grooved surface if desired to facilitate rotation of same by a user of dispenser 10.

Inner housing 12 is preferably substantially round in shape to facilitate rotation within outer housing 14 as desired. An inside surface of inner housing 12 may be provided with structure for engaging with the product platform as will be discussed below so that rotation of inner housing 12 also rotates the product platform relative to the plug and screw member as will also be discussed below.

As best shown in FIG. 6, inner housing 12 has an upper end 48 which has structure positioned to periodically align with openings 34 of outer housing 14 and thereby block or close same. In the embodiment illustrated, such structure is provided as a series of vanes 50 positioned extending radially from a center or axis of rotation of inner housing 12 and spaced from each other to define flow passages between vanes 50. In the embodiment shown, eight such vanes 50 are provided. Different numbers of vanes 50 can be provided depending upon the number of openings 34 in outer housing 14 and the amount of product which is desirable to dispense between sealing positioned of inner housing 12 relative to outer housing 14.

Inner housing 12 also has a lower end 52 which is also preferably substantially open to allow for assembly of remaining components of dispenser 10 and also preferably to allow bottom fill of the device.

Also as best shown in FIG. 6, inner housing 12 preferably has ribs 54 which extend radially outwardly a small distance. Ribs 54 engage with slots 38 in skirt 36 of outer housing 14 and serve to guide or urge inner housing 12 into a desired position relative to outer housing 14. According to the invention, ribs 54, slots 38, openings 34 and vanes 50 are positioned so that when ribs 54 engage slots 38, the dispenser is in a closed position wherein vanes 50 are aligned with and block openings 34 so as to automatically seal dispenser 10 against leakage. Between these engaged positions, the dispenser is in an open position wherein product can flow from the product space, through the openings in inner housing 12 and dispensing openings 34 in outer housing 14, to be applied or dispensed as desired. It should be appreciated that ribs 54 and slots 38 can be adapted in number and also in shape/depth so as to provide a desired "feel" for when they engage, thereby indicating closure to a user of the dispenser 10.

Figure 7:
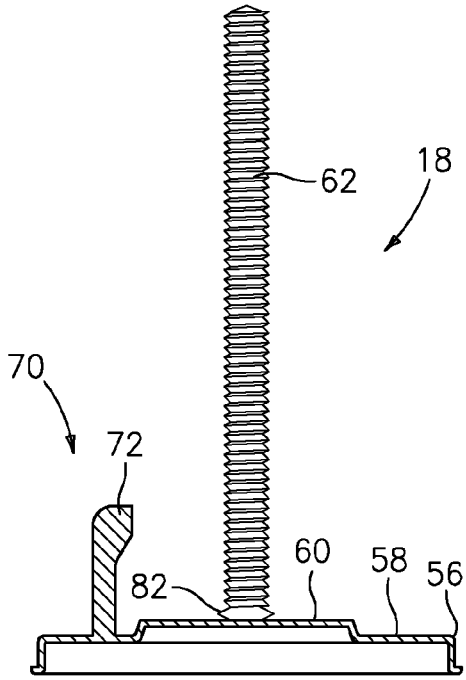
FIG. 7 is a side view of a plug-screw component of a dispenser according to the present invention.

FIG. 7 shows a plug and screw member 18 which advantageously has a lower base plate 56 which is adapted to snap into the bottom of outer housing 14. Base plate 56 has an upper surface 58 which preferably includes a raised portion 60 sized to fit within the lower end 52 of inner housing 12 and provide support for stable rotation of inner housing 12 relative to outer housing 14 as desired.

A threaded rod 62 advantageously extends upwardly from base plate 56 and extends a distance sufficient to allow substantially complete dispensing of product from dispenser 10 as desired. Threaded rod 62 should have threads which are positioned and have a pitch selected to provide a desired feed rate of liquid product per rotation of inner housing 12 relative to outer housing 14.

Figure 8:
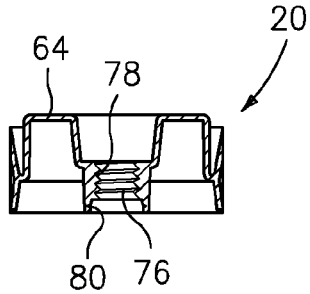
FIG. 8 shows a product platform of a dispenser according to the invention.

FIG. 8 shows a typical platform 20 which has a central structure for threadedly engaging with threaded rod 62, and which has a body portion 64 for applying force to liquid contained within inner housing 12 and thereby causing dispensing of same. Platform 20 preferably has an outside edge adapted to engage with the inner wall of inner housing 12 so as to engage platform 20 against rotation relative to inner housing 12. In this manner, rotation of inner housing 12 relative to outer housing 14 also serves to rotate platform 20 relative to threaded rod 62 as desired.

Figure 6A:
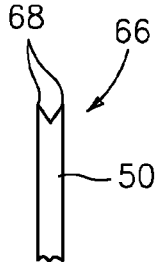
FIG. 6*a* illustrates a preferred structure of a closing vane according to the invention.

FIG. 6*a* shows a preferred form of vanes 50 according to the invention. As shown, vanes 50 can be provided with a scraping structure to help scrape product away from an inside edge of openings 34 in outer housing 14. As shown in FIG. 6*a*, this scraping structure can be provided in the form of a knife edge structure, preferably a double-knife edged structure as shown, which defines a V-shaped upward edge 66 of vane 50. This type of upper edge serves to define sharp scraping edges 68 as desired. Of course, other structures could be provided within the broad scope of the present invention, including a single sharp or blade scraping edge if desired.

FIG. 7 shows another embodiment of the invention wherein an extra clicker structure 70 can be provided. This is provided in the form of an arm 72 or other resilient member which rests against an outside surface of inner housing 12. As shown in FIG. 1, this outside surface of inner housing 12 can have ribs 74 or some other extending structure at this location as well, and as inner housing 12 is rotated relative to outer housing 14, arm 72 snaps past ribs 74 and produces an audible clicking sound which can help a user determine when enough product has been dispensed.

FIG. 1 shows platform 20 engaged with threaded rod 62 in a starting position which is also advantageously a fill position. As shown, platform 20 has an inner threaded portion 76 which includes a first portion 78 which is engaged with threaded rod 62, and a second portion 80. Threaded rod 62 preferably has an additional rib 82 which is not meshed with the threaded portion of rod 62, and which engages with second portion 80 in this initial or fill position, and which serves to hold platform 18 in this position during a fill procedure. The engagement of first portion 78 with threaded rod 62 allows the initial turns of inner housing 12 relative to outer housing 14 to disengage rib 82 from second portion 80 and allow normal movement of platform 18 along threaded rod 62 as desired.

Figure 1A:
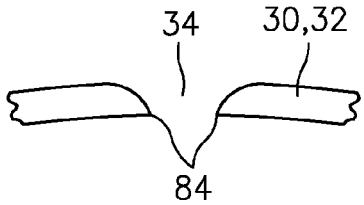
FIG. 1*a* is an enlarged portion of FIG. 1 showing a preferred structure of an opening in the top or applicator surface.

FIGS. 1 and 1*a* also show an additional preferred feature of the present invention, wherein openings 34 in top surface 32 are provided having upwardly spreading surfaces which advantageously define a sharp corner 84 at bottom edges of opening 34. These sharp corners or edges, defined by surfaces at an acute angle with each other, further help to prevent build up of dried or partially dried liquid product in openings 34 which could obstruct dispensing through same. Sharp corners 84 are defined between the upper or applicator surface and the lower or inner surface of the top of outer housing 14 around dispensing openings 34. According to the invention, and as set forth above, it is preferred that the engle between these surfaces be less than about 90°, preferably less than about 60°, and more preferably less than about 45°.

As set forth above, dispenser 10 is well adapted to a bottom filling procedure. In order to accomplish this, inner housing 12 can be positioned within outer housing 14, and cap 16 positioned over upper end 28 of outer housing 14. This first sub-assembly can then be inverted, and liquid product can be poured into same.

Platform 18 is positioned on threaded rod 62 with rib 82 engaged with second portion 80. This second sub-assembly is then inverted, and rib 82 and second portion 80 being engaged serves to prevent platform 18 from sliding down threaded rod 62. This second sub-assembly is then positioned into the first sub-assembly until base plate 56 snaps into place relative to inner housing 12 and outer housing 14, at which point the dispenser is filled and ready to be shipped or otherwise provided to distribution and/or a consumer or user.

When dispenser 10 is to be used, cap 16 is removed to expose wheel 46 extending through side openings 26, and wheel 46 can be used to rotate inner hosing 12 relative to outer housing 14. The initial turns disengage rib 82 from second portion 80, and serve to advance platform 20 along threaded rod 62 as desired, with such movement driving liquid product from within product space 44 through openings 34 and onto applicator surface 32. This rotation causes vanes 50 to sequentially align with openings 34 (closed position) and the gaps between the openings 34 (open or flow position), and engagement of ribs 54 with slots 38 gives a tactile feel for when vanes 50 are in a closed position relative to openings 34. When sufficient product is dispensed, wheel 46 can be turned slightly further until a closed position is sensed by engagement of ribs 54 with slots 38, and the product can then be applied as desired. Following application, cap 16 can be replaced over upper end 28 of outer housing 14, and covering wheel 46, so as to prevent inadvertent and/or unintended movement of wheel 46.

Dispenser 10 according to the invention can be made of any material, preferably an injection moldable material, which would be suitable for the intended structure and compatible with the liquid product to be contained therein. Such materials would be well known to a person of ordinary skill in the art.

It should be appreciated that a detailed description of a preferred embodiment has been provided. Alteration to parts, size and shape, as well as other alterations to the disclosed embodiment, would be readily apparent to a person of ordinary skill in the art and are considered to be well within the broad scope of the present invention.

The invention claimed is:

1. A dispenser, comprising:

an outer housing having a top defining an applicator surface and at least one dispensing opening in the applicator surface;

an inner housing defining a product space and having a top comprising at least one passage and at least one vane structure, the top being substantially adjacent to the dispensing opening of the outer housing, wherein the inner housing is rotatable relative to the outer housing around an axis so as to sequentially position the inner housing and the outer housing in an open position wherein the at least one passage of the inner housing is aligned with the at least one dispensing opening of the outer housing, and a closed position wherein the at least one vane structure of the inner housing is aligned with and blocks the at least one dispensing opening in the outer housing;

a base plate engaged with the outer housing;

a threaded rod supported by the base plate; and, a product platform supported on the threaded rod.

2. The dispenser of claim 1, further comprising an engaging structure between the inner housing and the outer housing, the engaging structure engaging when the at least one vane structure of the inner housing is aligned with the at least one dispensing opening of the outer housing.

3. The dispenser of claim 2, wherein the engaging structure comprises an extending structure on one of the inner housing and the outer housing and a receiving structure on the other of the inner housing and the outer housing, wherein rotation of the inner housing relative to the outer housing sequentially engages and disengages the engaging structure.

4. The dispenser of claim 3, wherein the outer housing further comprises a skirt member defining a substantially round rotational surface, and wherein the inner housing is rotatably received within the skirt member.

5. The dispenser of claim 4, wherein the engaging structure comprises at least one slot on the skirt member and at least one protrusion extending radially from the inner housing, whereby rotation sequentially engages and disengages the at least one protrusion with the at least one slot.

6. The dispenser of claim 4, wherein the skirt member extends downwardly from an inside surface of the top of the outer housing.

7. The dispenser of claim 1, wherein the at least one vane structure comprises a blocking surface alignable with the at least one dispensing opening in the closed position.

8. The dispenser of claim 7, wherein the blocking surface has a knife edge for scraping product from the dispensing opening when the inner housing is rotated relative to the outer housing.

9. The dispenser of claim 8, wherein the blocking surface has a double-knife edge defining a V-shaped top of the vane.

10. The dispenser of claim 1, wherein the dispensing opening is defined by an opening through the applicator surface and an inner surface of the top of the outer housing, and wherein an angle between the applicator surface and the inner surface of the top of the outer housing is less than about 90°.

11. The dispenser of claim 1, wherein the dispensing opening is defined by an opening through the applicator surface and an inner surface of the top of the outer housing, and wherein an angle between the applicator surface and the inner surface of the top of the outer housing is less than about 60°.

12. The dispenser of claim 1, wherein the dispensing opening is defined by an opening through the applicator surface and an inner surface of the top of the outer housing, and wherein an angle between the applicator surface and the inner surface of the top of the outer housing is less than about 45°.

13. The dispenser of claim 1, further comprising a radially extending wheel on the inner housing and at least one side opening on the outer housing, the wheel being accessible through the side opening for rotating the inner housing relative to the outer housing.

14. The dispenser of claim 13, further comprising a cap for the dispenser, the cap having a skirt portion which extends over the side opening whereby the wheel is covered by the cap when the cap is on the dispenser.

15. The dispenser of claim 1, wherein the platform is non-rotatably mounted relative to the inner housing whereby rotation of the inner housing relative to the outer housing rotates the platform relative to the threaded rod.

16. The dispenser of claim 15, wherein the platform has a central bore for receiving the threaded rod, and wherein the bore has a helical threaded portion for threaded engagement with the threaded rod, and a radial groove portion engaged with a rib on the threaded rod to resist initial axial movement of the platform relative to the threaded rod.

17. The dispenser of claim 1, further comprising a resilient member fixed relative to one of the inner housing and the outer housing, and an extending structure on the other of the inner housing and the outer housing, the resilient member snapping past the extending structure when the inner housing is rotated relative to the outer housing whereby a sensible indicator is generated during such rotation.

18. The dispenser of claim 1, wherein the outer housing has an open bottom, wherein the inner housing is rotatable received within the outer housing, and further comprising a base plate mounted in the open bottom.

* * * * *

UNITED STATES PATENT AND TRADEMARK OFFICE

CERTIFICATE OF CORRECTION

PATENT NO. : 7,648,300 B2
APPLICATION NO. : 11/394566
DATED : January 19, 2010
INVENTOR(S) : Alex Szekely It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 834 days.

Signed and Sealed this

Twenty-eighth Day of December, 2010

David J. Kappos

David J. Kappos
*Director of the United States Patent and Trademark Office*